US009530609B2

(12) United States Patent
Deuringer et al.

(10) Patent No.: US 9,530,609 B2
(45) Date of Patent: Dec. 27, 2016

(54) X-RAY APPARATUS

(71) Applicants: Josef Deuringer, Herzogenaurach (DE); Joerg Freudenberger, Kalchreuth (DE)

(72) Inventors: Josef Deuringer, Herzogenaurach (DE); Joerg Freudenberger, Kalchreuth (DE)

(73) Assignee: Siemens Aktiengesellschaft, München (DE)

( * ) Notice: Subject to any disclaimer, the term of this patent is extended or adjusted under 35 U.S.C. 154(b) by 275 days.

(21) Appl. No.: 13/629,079

(22) Filed: Sep. 27, 2012

(65) Prior Publication Data

US 2013/0077757 A1 Mar. 28, 2013

(30) Foreign Application Priority Data

Sep. 27, 2011 (DE) ..... 10 2011 083 495

(51) Int. Cl.
*H01J 35/10* (2006.01)

(52) U.S. Cl.
CPC ..... *H01J 35/101* (2013.01); *H01J 2235/104* (2013.01); *H01J 2235/1033* (2013.01)

(58) Field of Classification Search
CPC ..... H01J 35/101
USPC ..... 378/131, 144
See application file for complete search history.

(56) References Cited

U.S. PATENT DOCUMENTS 4,162,420 A * 7/1979 Grady ..... H01J 35/28 313/149
6,487,275 B1 * 11/2002 Baba et al. ..... 378/144
7,903,786 B2 * 3/2011 Zhong et al. ..... 378/129
2002/0021973 A1 * 2/2002 Nelson ..... F04D 25/066 417/355
2004/0240614 A1 * 12/2004 Tiwari ..... H01J 35/10 378/131
2010/0027753 A1 * 2/2010 Venugpal ..... H01J 35/101 378/130
2011/0002442 A1 * 1/2011 Thran et al. ..... 378/22

FOREIGN PATENT DOCUMENTS

CN 100543917 C 9/2009
CN 101965623 A 2/2011

OTHER PUBLICATIONS

German Office Action dated Feb. 28, 2012 for corresponding German Patent Application No. DE 10 2011 083 495.8 with English translation.

"Reluktanzantriebe für Batterie—und Brennstoffzellenfahrzeuge," Webpage, UniBwM, EAA Lehrstuhl für Elektrische Antriebstechnik und Aktorik, Universität der Bundeswehr München, http://www.unibw.de/eit61/forschungsschwerpunkte/forschung01, pp. 1-2, accessed Sep. 25, 2012.

(Continued)

*Primary Examiner* — Robert Kim
*Assistant Examiner* — Eliza Osenbaugh-Stewar
(74) *Attorney, Agent, or Firm* — Lempia Summerfield Katz LLC

(57) ABSTRACT

An x-ray apparatus includes an x-ray emitter having an x-ray tube, a rotary anode disposed in the x-ray tube, and a drive for the rotary anode. The drive includes a reluctance motor having a stator disposed outside the x-ray tube and a rotor disposed inside the x-ray tube. The rotor is mechanically connected to the rotary anode.

19 Claims, 4 Drawing Sheets

(56) References Cited

OTHER PUBLICATIONS

"Forschungsschwerpunkt—Geschaltete Reluktanzmaschine und—antriebe," Webpage, ISEA Institut für Stromrichtertechnik und Elektrische Antriebe, http://www.isea.rwth-aavhen.de/electricaldrives/focus/reluctance, pp. 1-2, accessed Sep. 25, 2012.
"Laboratories: Test-Benches and Additional Devices," Webpage, UniBwM, EAA Lehrstuhl für Elektrische Antriebstechnik und Aktorik, Universität der Bundeswehr München, http://www.unibw.de/eit61/forschung/labors?set_language=de, accessed Sep. 25, 2012.
C. Carstensen, "Eddy Currents in Windings of Switched Reluctance Machines," Dissertation, Aachener Beiträge des ISEA, Band 48, 2008.
J. Fiedler, "Design of Low-Noise Switched Reluctance Drives," Dissertation, an der RWTH Aachen, 2006.
Q. Yu et al., "An analytical Network for Switched Reluctance Machines with Highly Saturated Regions," Universität der Bundeswehr München, pp. 1-5, 2011.
C. Laudensack et al., Geschaltete Reluktanzmotoren als Antriebe für Spaltrohrpumpen (Switched Reluctance motors as canned pump drives), ETG Fachbericht 130, pp. 1-6, 2011.
Rik De Doncker et al., "Geschaltete Reluktanzmaschine als Antriebsalternative," Heft, ETZ, Sonderteil: E-Mobility, pp. 1-3, May 2011.
Chinese Office Action for Chinese Patent Application No. 201210363865.5, mailed Jul. 23, 2015, with English Translation.

* cited by examiner

X-RAY APPARATUS

This application claims the benefit of DE 10 2011 083 495.8, filed on Sep. 27, 2011.

BACKGROUND

The present embodiments relate to an x-ray apparatus.

In medicine, x-ray apparatuses are used for diagnosis. These types of x-ray apparatus have an x-ray emitter that includes an x-ray tube for generating x-rays. A cathode that emits electrons is arranged in the evacuated x-ray tube. The emitted electrons are accelerated by a high voltage in the direction of the anode and eventually penetrate into the anode material, through which x-rays are generated. When the electrons strike the anode, heat is also produced. To protect the anode against high levels of heat, rotary anodes are therefore used. A surface of the rotary anode struck by the electrons is made to rotate so that the heat is distributed by this action on the surface of the anode. This leads to a longer lifetime of the anode and makes a greater radiation intensity possible than would be achievable with a stationary anode. A rotary anode may be driven by an asynchronous motor. A stator of the asynchronous motor is located outside the x-ray tube, and a rotor of the asynchronous motor is disposed inside the x-ray tube. The rotor is mechanically connected to the rotary anode via a shaft.

SUMMARY AND DESCRIPTION

The types of anode drive of the prior art use a large amount of space and dominate the installed length of the x-ray tubes. For example, a third of the length of the x-ray tube may be the motor length. Because of the large air gap as a consequence of the vacuum envelope and the high-voltage installation, such drives have low efficiency. The structure of the rotor lying in the vacuum, which may have a copper bell, restricts the vacuum processes during tube production. The same applies to a rotor with permanent magnets as with a synchronous motor or to the use of the magnetic field coupling.

The present embodiments may obviate one or more of the drawbacks or limitations in the related art. For example, a smaller and more compact x-ray apparatus is provided.

In one embodiment, an x-ray apparatus includes an x-ray emitter having an x-ray tube, a rotary anode disposed in the x-ray tube and a drive for the rotary anode. The drive includes a reluctance motor having a stator disposed outside the x-ray tube and a rotor disposed inside the x-ray tube. The rotor is mechanically connected to the rotary anode.

The fact that the drive does not include an asynchronous motor but, for example, includes a switched reluctance motor, provides that a simple structure of the drive motor is achieved. For example, a drive with a smaller size is used with this approach, which thus simplifies the manufacturing process of the entire x-ray emitter and allows the x-ray emitter to be designed significantly smaller and more compact. Since the rotor of the reluctance motor, by contrast with a rotor of an asynchronous motor, does not consist of copper but may consist of iron and copper or permanently magnetic material no longer has to be introduced into the vacuum of the x-ray tube, higher temperatures are possible in the manufacturing process. A version of the rotor with permanent magnets similar to a synchronous motor would also restrict the vacuum process. The heat losses during operation of the motor in a vacuum are reduced, since no resistive copper losses in the rotor occur. For example, the reluctance motor is suitable for high speeds (e.g., in the range of 100-200 Hz), as are typically used with rotary anodes, since the motor operates efficiently.

In one embodiment, the stator is embodied in the form of a ring and completely surrounds the rotor. Such an embodiment thus corresponds in geometrical structure to the known x-ray emitters with an asynchronous motor. This embodiment is suitable in conventional x-ray emitters for replacement of the asynchronous motor by a reluctance motor.

In order to save further space and to reduce the manufacturing outlay, the stator is embodied as at least one circle segment and surrounds the rotor along the at least one circle segment. Thus, the stator does not form a complete circumferential ring around the rotor. If the stator includes a number of circle segments, the power may be varied by explicit activation of one or more circle segments.

In another embodiment, the stator and the rotor are each designed in the form of a disk and are spaced from one another in the direction of the axis of rotation. This results in a low space requirement (e.g., in the radial direction), since the stator does not radially enclose the rotor.

With the disk-type embodiment of rotor and stator, the stator may be disposed in the x-ray apparatus outside the x-ray emitter. This provides that during servicing, the stator may remain in the x-ray apparatus, so that during replacement of the x-ray emitter, the stator does not have to be replaced.

In one embodiment, the axis of rotation of the rotary anode is inclined in relation to a direction of an electron beam striking the rotary anode. In one embodiment, the axis of rotation is inclined such that the electron beam strikes an end face side of the rotary anode pointing radially outwards. This provides that areas with a high circumferential speed are irradiated, so that overheating of the rotary anode is avoided through this configuration.

DETAILED DESCRIPTION OF THE DRAWINGS

Figure 1:
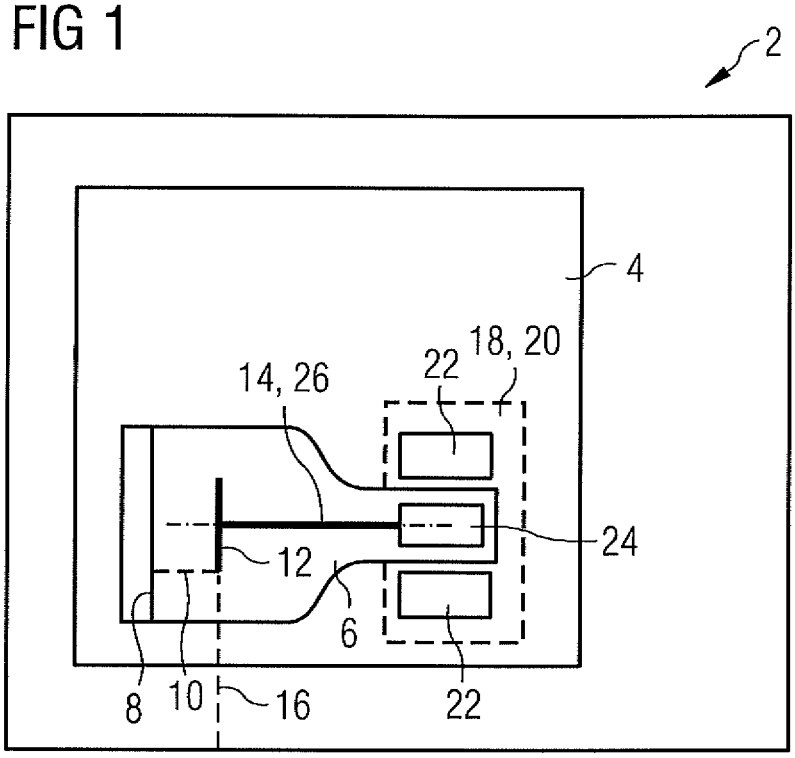
FIG. 1 shows a cross-section through one embodiment of an x-ray apparatus.

FIG. 1 shows one embodiment of an x-ray apparatus 2 with an x-ray emitter 4. The x-ray emitter 4 includes an x-ray tube 6 that is delimited by a glass bulb. Located within the evacuated x-ray tube 6 is a cathode 8 that is used to create an electron beam 10. The electron beam 10 strikes a rotary anode 12 that has an axis of rotation 14. X-rays 16 that are used for diagnostic purposes are generated by the electrons striking the rotary anode 12. Simultaneously, heat is also generated by the electrons striking the rotary anode 12, which may lead to the anode material being damaged. To avoid this type of overheating, the rotary anode 12 is thus made to rotate. For this purpose, the x-ray apparatus 2 has a drive 18 for the rotary anode 12. The drive 18 includes a reluctance motor 20 that has a stator 22 disposed outside the x-ray tube 6 and inside the x-ray emitter 4, and a rotor 24 disposed inside the x-ray tube 6 (e.g., in the vacuum). The rotor 24 is connected mechanically to the rotary anode 12 by a shaft 26. The reluctance motor is, for example, configured for a higher speed range of, for example, 100 Hz to 200 Hz, so that an efficient operation and thereby a compact layout is produced.

Figure 2:
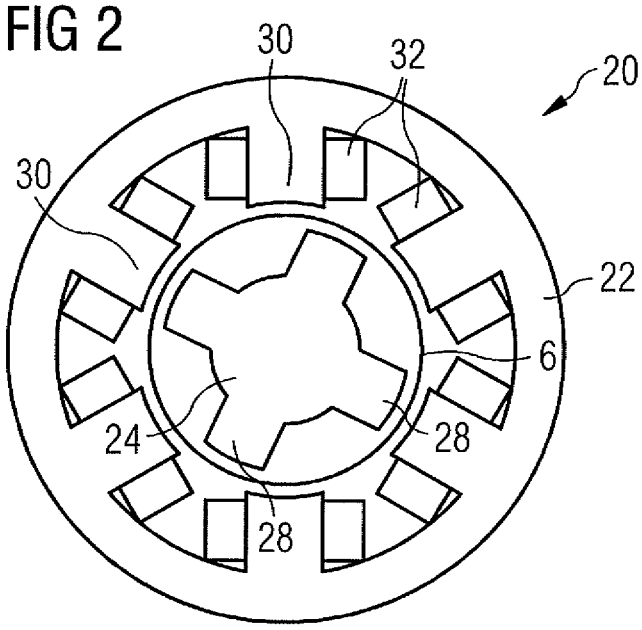
FIG. 2 shows a cross-section through one embodiment of a reluctance motor with a stator embodied in the form of a ring.

FIG. 2 shows a cross-section through the reluctance motor 20. This includes a rotor 24 lying inside the x-ray tube 6. The rotor 24 has, for example, four teeth 28. The stator 22 disposed outside the x-ray tube 6 is embodied in the form of a ring and encloses the rotor 24 around the entire circumference. The stator 22 has a number of stator teeth 30 (e.g., six stator teeth) that are each wound with a coil 32. Each coil 32 may be individually supplied with power. The stator teeth 30 with the powered coils 32 each attract the closest tooth 28 of the rotor 24, so that the rotor 24 is set into motion. The corresponding coil 32 is powered down when the tooth 28 of the rotor 24 is opposite the stator tooth 28 attracting the tooth 28. In this position, power is applied to the next stator tooth 30 with the aid of the assigned coil 32, so that a continuous rotary movement of the rotor 24 is generated.

Figure 3:
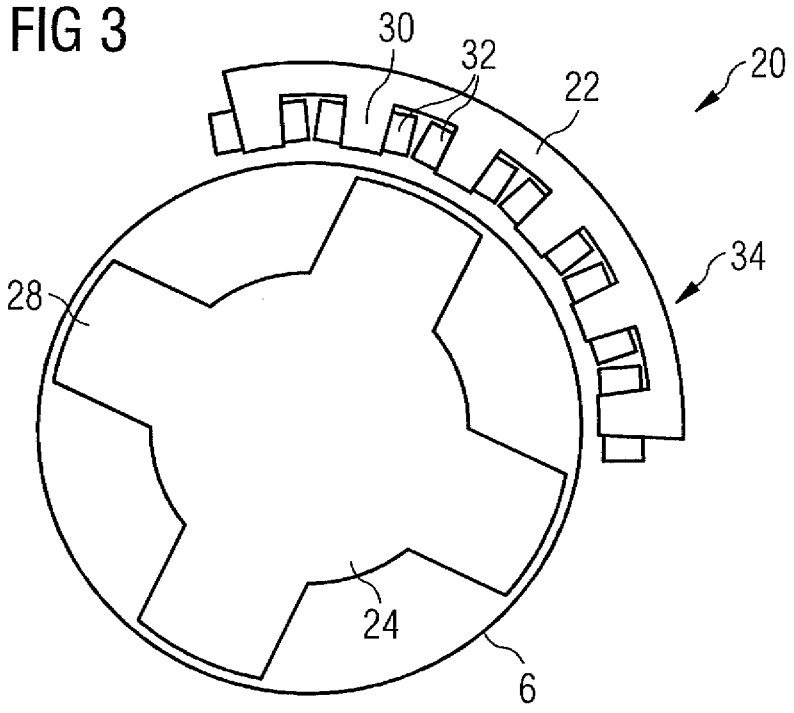
FIG. 3 shows a cross-section through one embodiment of a reluctance motor with a stator embodied in the form of a circle segment.

FIG. 3 shows a further embodiment of a reluctance motor 20 with a rotor 24 and a stator 22 disposed outside the x-ray tube 6, which is embodied as a circle segment 34 and encloses the rotor 24 along the circle segment 34. By contrast with the embodiment shown in FIG. 2, the stator 22 does not enclose the full circumference of the rotor 24 but only a part of a circle surrounding the rotor 24. Such a circle segment 34, however, otherwise corresponds to the structure of the stator 22 in FIG. 2. The stator 22 has a number of stator teeth 30 that are each wound with a coil 32 and interact with the teeth 28 of the rotor 24.

In such an embodiment of the reluctance motor 20, further space may be saved for the drive 18 of the anode. Such a reluctance motor 20 may have a stator 22 including a number of circle segments 34. This makes power adaptation possible in that, depending on the power of the drive 18 needed, one or more circle segments of the stator 22 may be driven.

Figure 4:
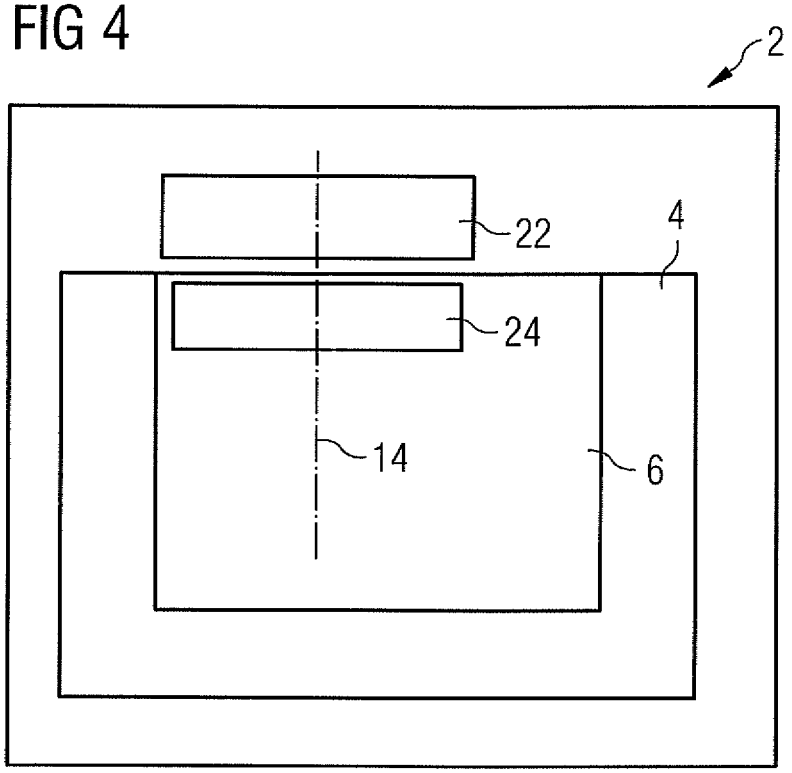
FIG. 4 shows a side view of one embodiment of a reluctance motor with stator and rotor embodied in the form of disks.
Figure 5:
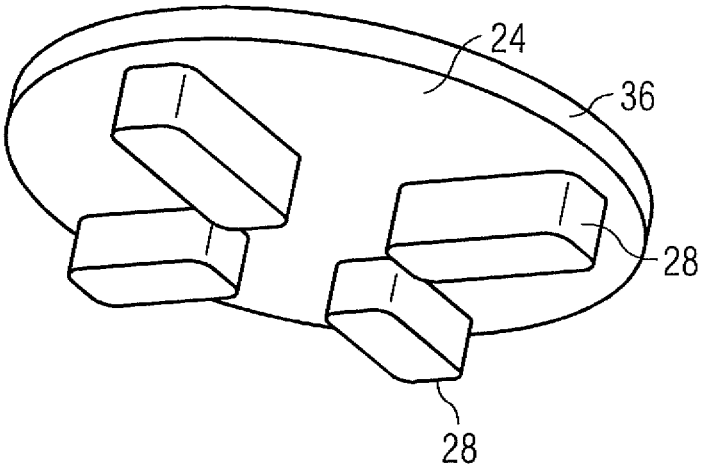
FIG. 5 shows a perspective view a rotor embodied in the form of a disk.
Figure 6:
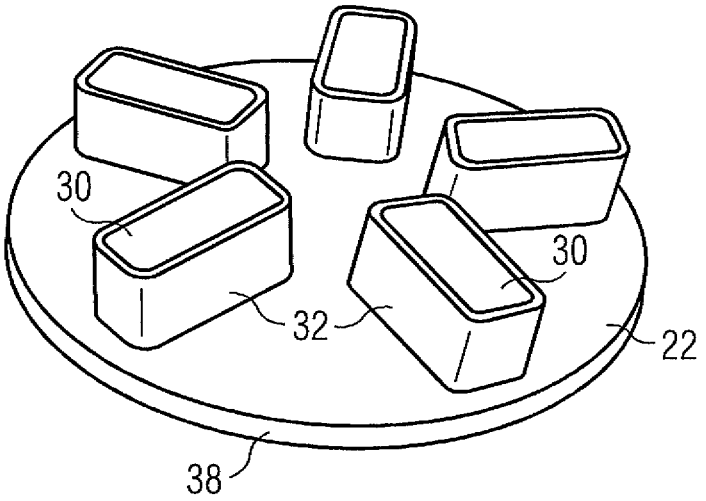
FIG. 6 shows a perspective view of a stator embodied in the form of a disk.

FIGS. 4-6 show a further embodiment of the x-ray apparatus 2. In this embodiment, stator 22 and rotor 24 are each embodied in the form of disks and are spaced apart from each other in the direction of the axis of rotation 14. Such an embodiment makes it possible for the stator 22 not only to be disposed outside the x-ray tube 6 but also outside the x-ray emitter 4 in the x-ray apparatus 2, as is shown in FIG. 4. The result achieved by such an embodiment is that when the x-ray emitter 4 is replaced (e.g., during servicing), the stator 22 built permanently into the x-ray apparatus 2 does not have to be replaced as well but may remain in the x-ray apparatus 2.

FIG. 5 shows a perspective view of the rotor 24 of the embodiment shown in FIG. 4. The rotor includes a disk 36, on which four teeth 28 are disposed.

FIG. 6 shows a corresponding stator 22 that includes a disk 38, on which a number of stator teeth 30 are disposed. Each of the stator teeth 30 is surrounded by a coil 32, and the stator teeth 30 interact with the teeth 28 of the rotor 24.

Figure 7:
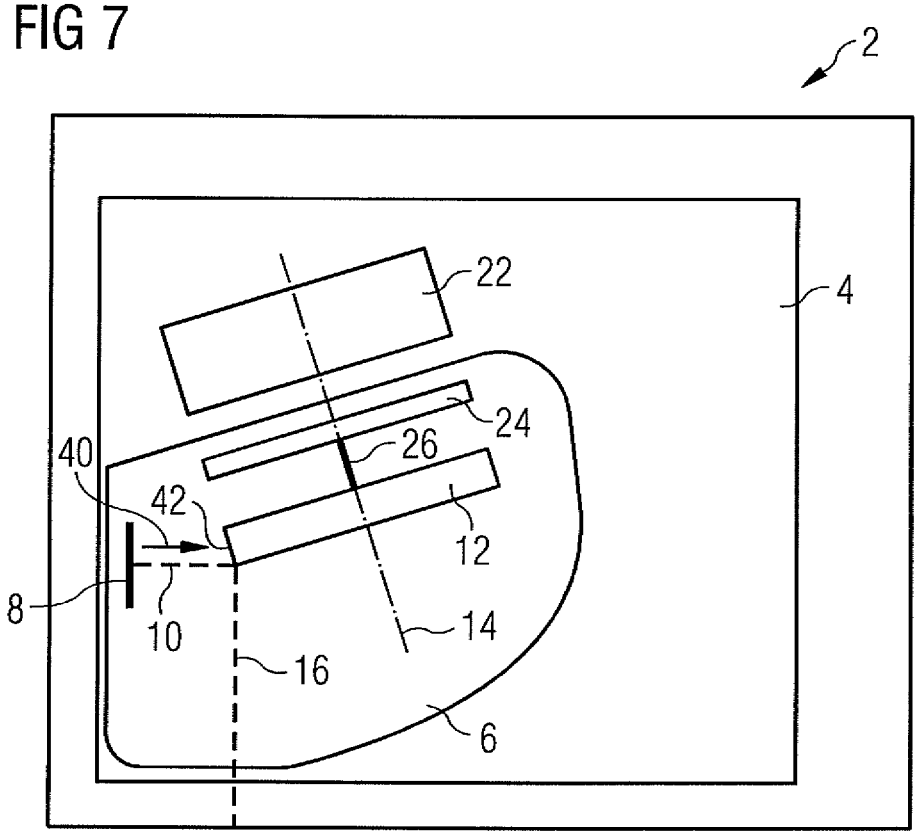
FIG. 7 shows one embodiment of an x-ray apparatus, in which an axis of rotation of the rotary anode is inclined.

FIG. 7 shows one embodiment of an x-ray apparatus 2, in which the rotor 24 and stator 22 are each embodied in the form of a disk and are spaced from the axis of rotation 14. Both the rotor 24 and the stator 22 are located inside the x-ray emitter 4. Because of the savings in using the drive 18 for the rotary anode 12, the axis of rotation 14 may be inclined in relation to a direction 40 of an electron beam 10 striking such that the electron beam 10 strikes an end face side 42 of the rotary anode 12 facing radially outwards. The fact that this area has a high circumferential speed provides that the rotary anode 12 is protected effectively against damage from heat.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An x-ray apparatus comprising:

an x-ray emitter comprising:

an x-ray tube configured to generate an electron beam;

a rotary anode disposed in the x-ray tube, wherein the x-ray tube is configured to generate the electron beam, such that the electron beam intersects the rotary anode; and a drive for the rotary anode, wherein the drive comprises a reluctance motor having a stator disposed outside the x-ray tube, and a rotor disposed inside the x-ray tube, the rotor being mechanically connected to the rotary anode; and wherein an axis of rotation of the rotary anode is oblique to a direction of the electron beam.

2. The x-ray apparatus as claimed in claim 1, wherein the stator is configured in the form of a ring and encloses the rotor around the entire circumference of the rotor.

3. The x-ray apparatus as claimed in claim 2, wherein the rotary anode is moveable within a speed range of 100 Hz to 200 Hz.

4. The x-ray apparatus as claimed in claim 3 wherein the axis of rotation is inclined such that the electron beam is configured to strike an end face side of the rotary anode pointing radially outwards.

5. The x-ray apparatus as claimed in claim 2 wherein the axis of rotation is inclined such that the electron beam is configured to strike an end face side of the rotary anode pointing radially outwards.

6. The x-ray apparatus as claimed in claim 1, wherein the stator is configured as at least one circle segment and surrounds the rotor along the at least one circle segment.

7. The x-ray apparatus as claimed in claim 6, wherein the rotary anode is moveable within a speed range of 100 Hz to 200 Hz.

8. The x-ray apparatus as claimed in claim 7 wherein the axis of rotation is inclined such that the electron beam is configured to strike an end face side of the rotary anode pointing radially outwards.

9. The x-ray apparatus as claimed in claim 6 wherein the axis of rotation is inclined such that the electron beam is configured to strike an end face side of the rotary anode pointing radially outwards.

10. The x-ray apparatus as claimed in claim 1, wherein the stator and the rotor are configured in the form of disks and are spaced apart from each other in a direction of an axis of rotation.

11. The x-ray apparatus as claimed in claim 10, wherein the rotary anode is moveable within a speed range of 100 Hz to 200 Hz.

12. The x-ray apparatus as claimed in claim 10 wherein the axis of rotation is inclined such that the electron beam is configured to strike an end face side of the rotary anode pointing radially outwards.

13. The x-ray apparatus as claimed in claim 1, wherein the stator is disposed in the x-ray apparatus but outside the x-ray emitter.

14. The x-ray apparatus as claimed in claim 13, wherein the rotary anode is moveable within a speed range of 100 Hz to 200 Hz.

15. The x-ray apparatus as claimed in claim 13 wherein the axis of rotation is inclined such that the electron beam is configured to strike an end face side of the rotary anode pointing radially outwards.

16. The x-ray apparatus as claimed in claim 1, wherein the axis of rotation is inclined such that the electron beam strikes an end face side of the rotary anode pointing radially outwards.

17. The x-ray apparatus as claimed in claim 16, wherein the rotary anode is moveable within a speed range of 100 Hz to 200 Hz.

18. The x-ray apparatus as claimed in claim 1, wherein the rotary anode is moveable within a speed range of 100 Hz to 200 Hz.

19. The x-ray apparatus as claimed in claim 18 wherein the axis of rotation is inclined such that the electron beam is configured to strike an end face side of the rotary anode pointing radially outwards.

* * * * *